US009022049B1

(12) United States Patent
Ma

(10) Patent No.: US 9,022,049 B1
(45) Date of Patent: May 5, 2015

(54) UMBRELLA TOP NOTCH AND RUNNER

(71) Applicant: Joen-Shen Ma, Taipei (TW)

(72) Inventor: Joen-Shen Ma, Taipei (TW)

( * ) Notice: Subject to any disclaimer, the term of this patent is extended or adjusted under 35 U.S.C. 154(b) by 0 days.

(21) Appl. No.: 14/288,554

(22) Filed: May 28, 2014

(51) Int. Cl.
*A45B 25/06* (2006.01)
*A45B 25/10* (2006.01)

(52) U.S. Cl.
CPC ..... *A45B 25/06* (2013.01); *A45B 25/10* (2013.01)

(58) Field of Classification Search
CPC ..... A45B 25/06; A45B 25/10; A45B 25/08
USPC ..... 135/28, 29, 30
See application file for complete search history.

(56) References Cited

U.S. PATENT DOCUMENTS

| | | | | |
|---|---|---|---|---|
| 847,805 | A * | 3/1907 | McAvoy | 135/30 |
| 2,762,383 | A * | 9/1956 | Wittman | 135/28 |
| 2,796,073 | A * | 6/1957 | Wittman | 135/28 |
| 5,655,557 | A * | 8/1997 | Martin | 135/15.1 |
| 6,311,706 | B1 * | 11/2001 | Sato | 135/28 |
| 6,314,976 | B1 * | 11/2001 | Clarke | 135/28 |
| 6,386,214 | B1 * | 5/2002 | Clarke | 135/20.3 |
| 7,318,444 | B2 * | 1/2008 | Clarke | 135/29 |
| 7,686,024 | B1 * | 3/2010 | Lai | 135/29 |
| 8,096,310 | B2 * | 1/2012 | Clarke | 135/16 |
| 8,136,541 | B2 * | 3/2012 | Beaulieu | 135/28 |
| 2010/0139724 | A1 * | 6/2010 | Lai | 135/29 |
| 2010/0139725 | A1 * | 6/2010 | Lai | 135/29 |
| 2012/0180834 | A1 * | 7/2012 | Pineda | 135/25.1 |

FOREIGN PATENT DOCUMENTS

| | | | |
|---|---|---|---|
| DE | 2014004723 | U1 * | 6/2014 |
| FR | 1436059 | A * | 4/1966 |

* cited by examiner

*Primary Examiner* — David R Dunn
*Assistant Examiner* — Danielle Jackson
(74) *Attorney, Agent, or Firm* — Rosenberg, Klein & Lee

(57) ABSTRACT

An improved umbrella top notch and runner are provided for an umbrella including a shaft, plural ribs, and plural stretchers, in addition to the top notch and the runner. The top notch, structurally the same as the runner, includes a main body and plural building blocks. Each building block has a threaded hole through which a screw rod can pass to fasten the building block to the periphery of the main body. Each building block has a projecting pin on one lateral side and a recess on the opposite lateral side. When the building blocks are fastened to the periphery of the main body, the front end of the projecting pin on one lateral side of each building block is fittingly received in the recess of the adjacent building block. Each building block can be detached from the main body to facilitate replacement of the ribs and stretchers.

4 Claims, 5 Drawing Sheets

UMBRELLA TOP NOTCH AND RUNNER

BACKGROUND OF THE INVENTION

1. Technical Field

The present invention relates to an umbrella top notch and an umbrella runner. More particularly, the present invention relates to an improved umbrella top notch and an improved umbrella runner, wherein the top notch and the runner are composed of detachable components, including a plurality of building blocks detachable from a main body to facilitate assembly and replacement of the ribs and stretchers of the umbrella.

2. Description of Related Art

Referring to FIG. 1, the basic structure of an umbrella typically includes a shaft 10, a top notch 11, a runner 12, a plurality of ribs 13, and a plurality of stretchers 14. The top notch 11 is fixed at the top end of the shaft 10. The runner 12 is mounted around the shaft 10 and can slide upward and downward along the shaft 10. Each rib 13 has an upper end pivotally connected to the top notch 11. Each stretcher 14 has an upper end pivotally connected to an intermediate portion of one of the ribs 13 and a lower end pivotally connected to the runner 12. The canopy of the umbrella can be opened or closed by sliding the runner 12 upward or downward along the shaft 10.

In terms of manufacture, the ribs 13 cannot be detached from the top notch 11 once they are assembled together; neither can the stretchers 14 be detached from the runner 12 in the assembled state. Therefore, should any of the ribs 13 or stretchers 14 be damaged and render the entire umbrella useless, it is impossible to remove the damaged rib 13 or stretcher 14 from the top notch 11 or the runner 12 for replacement. The user has no choice but to discard the umbrella and buy a new one, which constitutes a wasteful use of resources.

BRIEF SUMMARY OF THE INVENTION

It is an objective of the present invention to provide an improved umbrella top notch and runner which can overcome the aforesaid drawback of the conventional umbrellas, namely failure to allow replacement of a damaged rib 13 or stretcher 14.

The most obvious feature of the present invention is this: the umbrella top notch and runner are composed of detachable components, in which the building blocks can be detached from the main body to enable rapid assembly and replacement of ribs and stretchers.

To achieve the above and other objectives, the following technical solutions are adopted in the present invention.

The improved top notch and runner of the present invention are designed for use in an umbrella which includes a shaft, a plurality of ribs, and a plurality of stretchers, in addition to the top notch and the runner.

The top notch and the runner have the same structure and are composed of the same components.

The top notch includes a main body and a plurality of building blocks.

Each of the building blocks is provided with a threaded hole through which a screw rod can extend to fasten the building block to the periphery of the main body.

Each of the building blocks has a lateral side provided with a projecting pin and an opposite lateral side provided with a recess.

When the building blocks are fastened to the periphery of the main body, the front end of the projecting pin on one lateral side of each building block is fittingly received in the recess of the adjacent building block.

Thus, when any of the building blocks, any of the ribs, or any of the stretchers is damaged, the corresponding screw rod can be unfastened and removed, allowing the damaged or corresponding building block to be detached from the main body so that a new building block or a new rib or stretcher can be put in place.

As the top notch and the runner of the present invention are composed of the same detachable components, it is feasible to produce the building blocks according to a single set of specifications and apply the building blocks thus produced to both the top notch and the runner. Thus, production costs can be reduced, and assembly of the umbrella can be conveniently and rapidly completed.

Should any rib, stretcher, or building block of the top notch or runner of the umbrella is damaged, the detachable building blocks of the present invention allow convenient and rapid replacement, making it unnecessary to discard the entire umbrella. Hence, the intended objective of preventing wasteful use of resources is achieved.

BRIEF DESCRIPTION OF THE SEVERAL VIEWS OF THE DRAWINGS

The components and structures of some illustrative embodiments of the present invention are detailed hereinafter with reference to the accompanying drawings, in which.

DETAILED DESCRIPTION OF THE INVENTION

Figure 1:
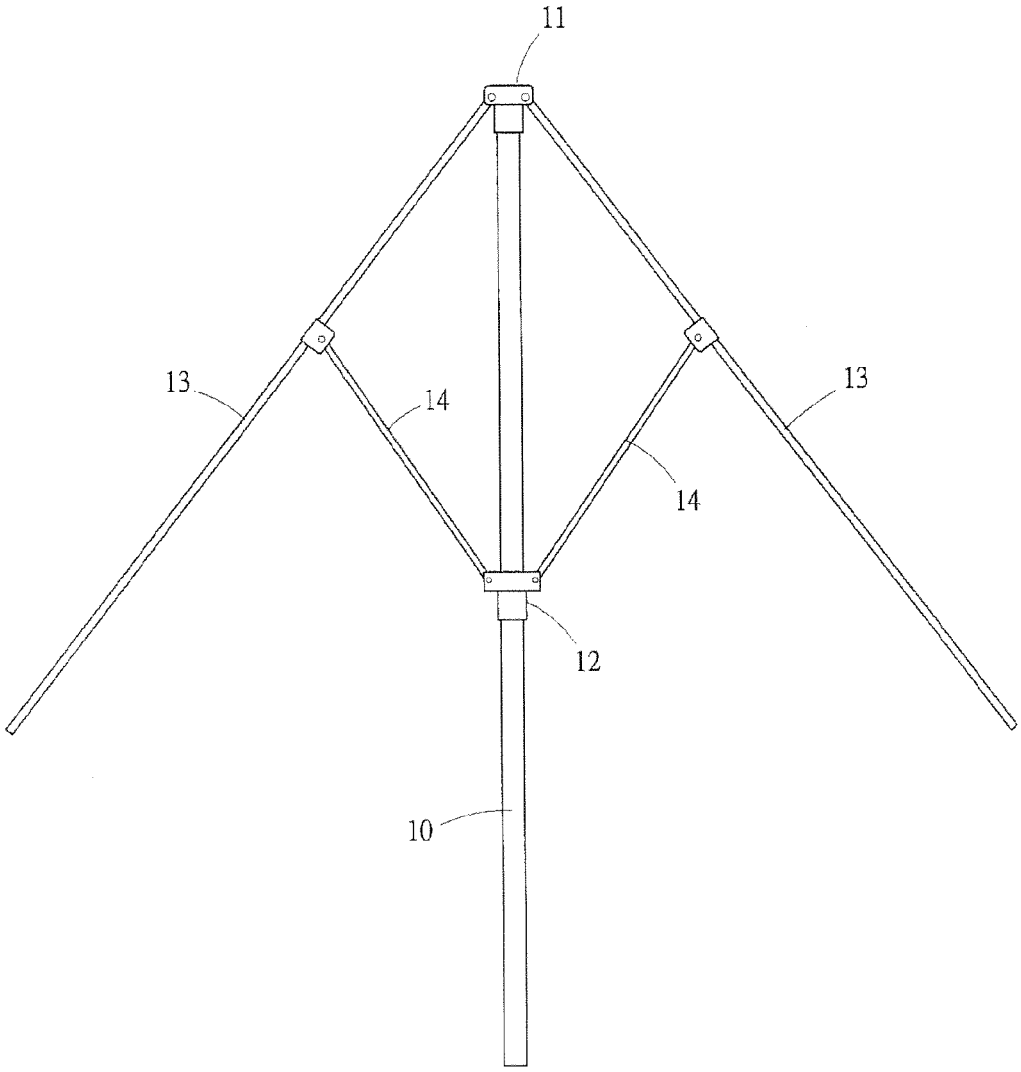
FIG. 1 is a structural diagram of an umbrella.

FIG. 1 is a structural diagram of an umbrella.

Figure 2:
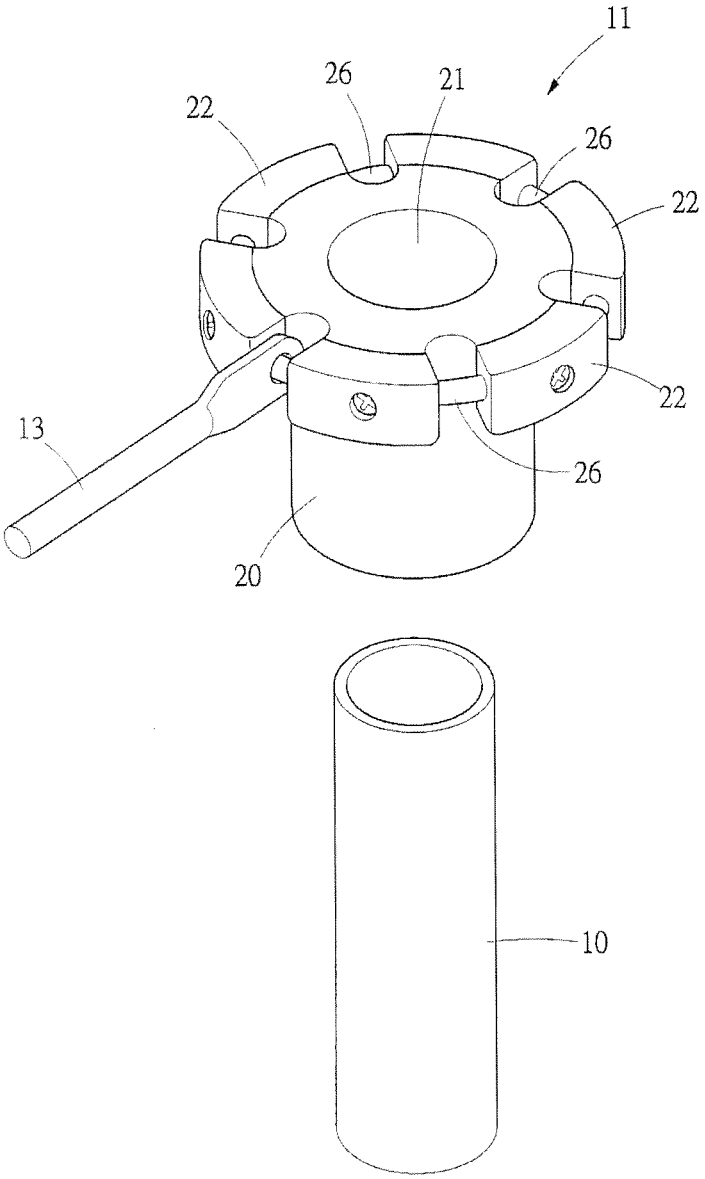
FIG. 2 is a perspective view of a top notch of the present invention and a shaft.

FIG. 2 is a perspective view of a top notch 11 of the present invention and a shaft 10.

Figure 3:
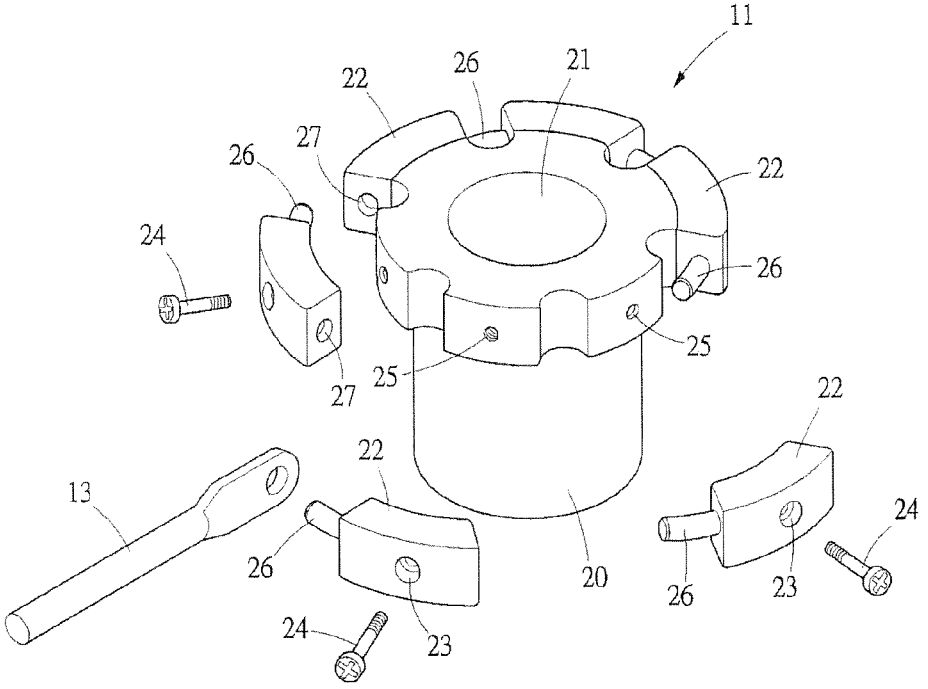
FIG. 3 is an exploded view of a top notch of the present invention.

FIG. 3 is an exploded view of a top notch 11 of the present invention.

Figure 4:
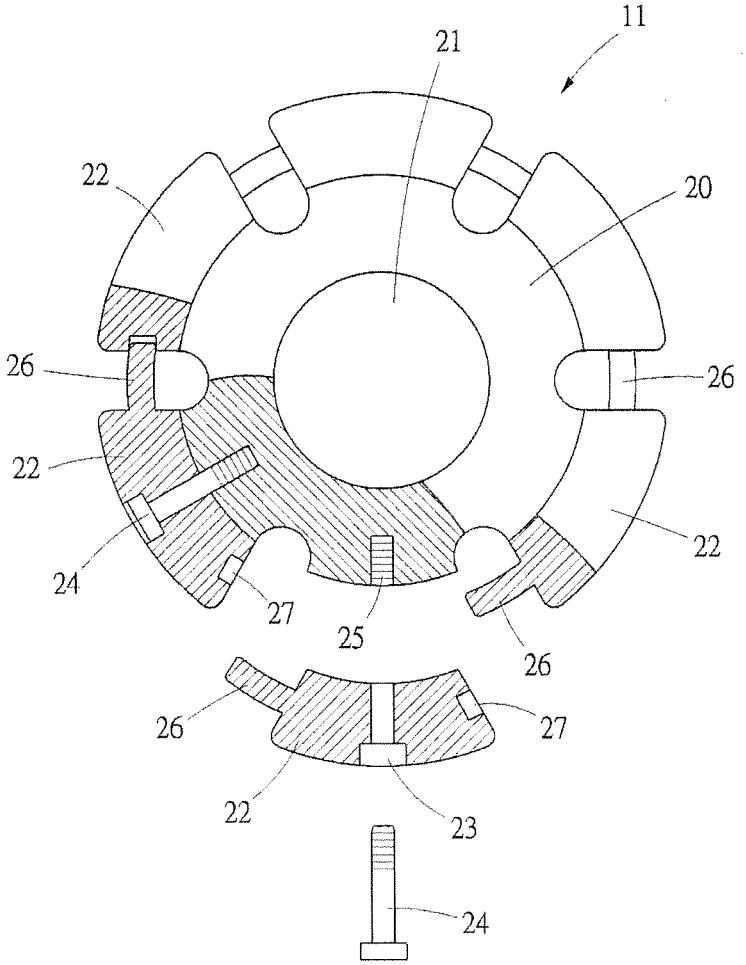
FIG. 4 is a sectional view of the top notch shown in FIG. 3.

FIG. 4 is a sectional view of the top notch 11 shown in FIG. 3.

Referring to FIG. 1 and FIG. 2, the improved top notch 11 and runner 12 of the present invention are configured for use in an umbrella which includes a shaft 10, a plurality of ribs 13, and a plurality of stretchers 14, in addition to the top notch 11 and the runner 12.

The top notch 11 and the runner 12 have the same structure and are composed of the same components.

As shown in FIG. 3, the top notch 11 includes a main body 20 and a plurality of building blocks 22.

As shown in FIG. 2, the main body 20 has an axial hole 21 which penetrates the axial ends of the main body 20. The axial hole 21 is configured for receiving the shaft 10 so that the top notch 11 can be fixed at the top end of the shaft 10.

All the building blocks 22 are structurally identical. Each building block 22 is provided with a threaded hole 23. A screw rod 24 can extend through the threaded hole 23 of each building block 22 to fasten the building block 22 to a threaded hole 25 in the periphery of the main body 20.

Each building block 22 is provided with a projecting pin 26 on one lateral side and a recess 27 on the opposite lateral side.

As shown in FIG. 4, when the building blocks 22 are fastened to the periphery of the main body 20, the front end of the projecting pin 26 on one lateral side of each building block 22 is fittingly received in the recess 27 of the adjacent building block 22.

Once all the building blocks 22 are fastened to the periphery of the main body 20, the top notch 11 is completed, as shown in FIG. 2. In addition, the projecting pin 26 of each building block 22 extends through the hole at the upper end of one of the ribs 13 such that the ribs 13 are pivotally connected to the top notch 11.

The top notch 11 is so configured that, when any of the building blocks 22 is damaged, or when any of the ribs 13 (or stretchers 14) is damaged, the corresponding screw rod 24 can be unfastened and removed, allowing the damaged or corresponding building block 22 to be detached from the main body 20, and a new building block 22 or a new rib 13 (or stretcher 14) to be put in place.

Figure 5:
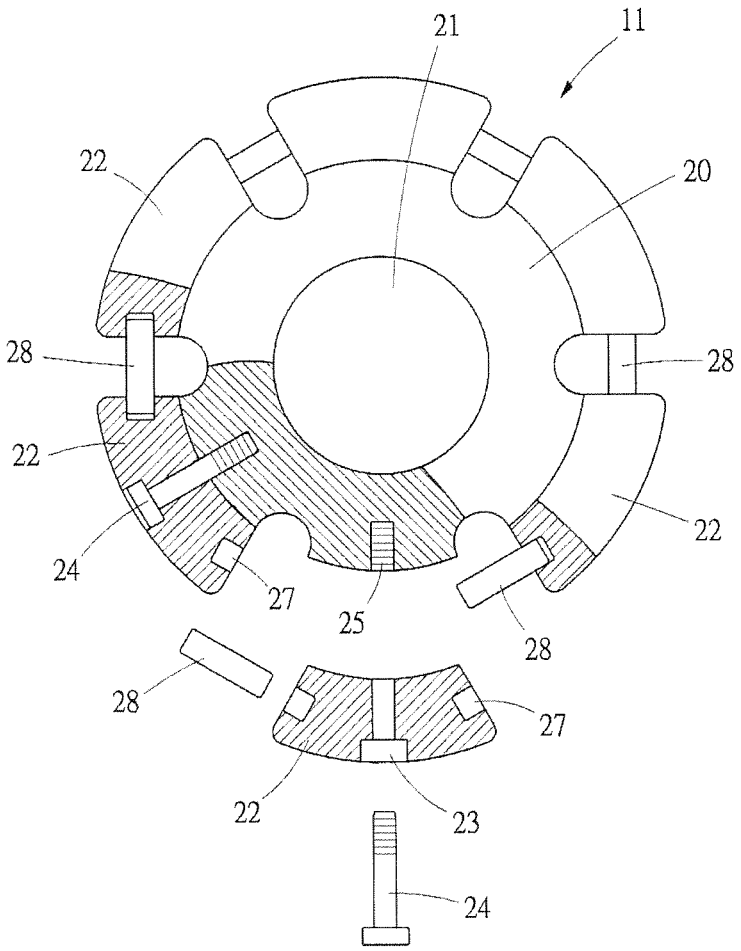
FIG. 5 is a sectional view of the top notch in the second embodiment of the present invention.

FIG. 5 shows the top notch 11 in the second embodiment of the present invention in sectional view.

In the embodiment shown in FIG. 5, each building block 22 of the top notch 11 is provided with a recess 27 on each of two opposite lateral sides, and a pin 28 is provided in the two corresponding recesses 27 of each two adjacent building blocks 22. Each pin 28 extends through the hole at the upper end of one of the ribs 13 such that the ribs 13 are pivotally connected to the top notch 11.

In the embodiment shown in FIG. 2 to FIG. 4, each building block 22 and its projecting pin 26 are integrally formed; in the embodiment shown in FIG. 5, the building blocks 22 and the pins 28 are separate components. Both embodiments, however, have the same effects.

The advantages of the improved umbrella top notch and runner of the present invention are obvious. As the top notch 11 and the runner 12 are composed of the same main body 20 and the same detachable building blocks 22, it is feasible to produce the main body 20 and the building blocks 22 according to a single set of specifications and apply the finished components to both the top notch 11 and the runner 12. This not only helps reduce production costs but also facilitates assembly.

When any of the ribs 13, stretchers 14, or the top notch or runner building blocks 22 is damaged, the detachable building blocks 22 of the present invention allow convenient and rapid replacement, thereby eliminating the need to discard the entire umbrella. As such, the intended objective of preventing wasteful use of resources is achieved.

What is claimed is:

1. An umbrella top notch, for use in an umbrella including a shaft, a runner, a plurality of ribs, and a plurality of stretchers, in addition to the top notch, the top notch comprising:

a main body having an axial hole penetrating axial ends of the main body, the axial hole being configured for receiving the shaft; and a plurality of building blocks having a same structure, each said building block being provided with a threaded hole through which a screw rod can extend to fasten the building block to a periphery of the main body, each said building block having a lateral side provided with a projecting pin and an opposite lateral side provided with a recess;

wherein when the building blocks are fastened to the periphery of the main body, a front end of the projecting pin on the lateral side of each said building block is fittingly received in the recess of an adjacent said building block, thereby completing the top notch, and wherein the projecting pin of each said building block extends through a hole at an end of one of the ribs such that the ribs are pivotally connected to the top notch.

2. An umbrella top notch, for use in an umbrella including a shaft, a runner, a plurality of ribs, and a plurality of stretchers, in addition to the top notch, the top notch comprising:

a main body having an axial hole penetrating axial ends of the main body, the axial hole being configured for receiving the shaft; and a plurality of building blocks having a same structure, each said building block being provided with a threaded hole through which a screw rod can extend to fasten the building block to a periphery of the main body, each said building block having two opposite lateral sides, each said lateral side being provided with a recess, there being a pin provided in two corresponding said recesses of each two adjacent said building blocks, each said pin extending through a hole at an end of one of the ribs such that the ribs are pivotally connected to the top notch.

3. An umbrella runner, for use in an umbrella including a shaft, a top notch, a plurality of ribs, and a plurality of stretchers, in addition to the runner, the runner comprising:

a main body having an axial hole penetrating axial ends of the main body, the axial hole being configured for receiving the shaft; and a plurality of building blocks having a same structure, each said building block being provided with a threaded hole through which a screw rod can extend to fasten the building block to a periphery of the main body, each said building block having a lateral side provided with a projecting pin and an opposite lateral side provided with a recess;

wherein when the building blocks are fastened to the periphery of the main body, a front end of the projecting pin on the lateral side of each said building block is fittingly received in the recess of an adjacent said building block, thereby completing the runner, and wherein the projecting pin of each said building block extends through a hole at an end of one of the stretchers such that the stretchers are pivotally connected to the runner.

4. An umbrella runner, for use in an umbrella including a shaft, a top notch, a plurality of ribs, and a plurality of stretchers, in addition to the runner, the runner comprising:

a main body having an axial hole penetrating axial ends of the main body, the axial hole being configured for receiving the shaft; and a plurality of building blocks having a same structure, each said building block being provided with a threaded hole through which a screw rod can extend to fasten the building block to a periphery of the main body, each said building block having two opposite lateral sides, each said lateral side being provided with a recess, there being a pin provided in two corresponding said recesses of each two adjacent said building blocks, each said pin extending through a hole at an end of one of the stretchers such that the stretchers are pivotally connected to the runner.

* * * * *